US009382891B2

(12) United States Patent
Fujii et al.

(10) Patent No.: US 9,382,891 B2
(45) Date of Patent: Jul. 5, 2016

(54) ENGINE CONTROL APPARATUS

(75) Inventors: Yoshihisa Fujii, Hitachinaka (JP); Osamu Mukaihara, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 163 days.

(21) Appl. No.: 14/239,280

(22) PCT Filed: Aug. 6, 2012

(86) PCT No.: PCT/JP2012/069945

§ 371 (c)(1), (2), (4) Date: Feb. 18, 2014

(87) PCT Pub. No.: WO2013/027563

PCT Pub. Date: Feb. 28, 2013

(65) Prior Publication Data

US 2014/0196681 A1 Jul. 17, 2014

(30) Foreign Application Priority Data

Aug. 23, 2011 (JP) ..... 2011-181605

(51) Int. Cl.

| | |
|---|---|
| ***F02N 11/02*** | (2006.01) |
| ***F02N 11/08*** | (2006.01) |
| ***F02N 15/06*** | (2006.01) |
| ***F02D 29/02*** | (2006.01) |
| *F02N 11/00* | (2006.01) |

(52) U.S. Cl.

CPC ..... *F02N 11/0851* (2013.01); *F02D 29/02* (2013.01); *F02N 11/0855* (2013.01); *F02N 15/06* (2013.01); *F02N 11/0814* (2013.01)

(58) Field of Classification Search

CPC .. F02N 11/0851; F02N 11/0855; F02N 15/06

USPC ..... 123/179.25, 179.4, 179.3, 179.28; 701/112, 113

See application file for complete search history.

(56) References Cited

U.S. PATENT DOCUMENTS

| | | | | |
|---|---|---|---|---|
| 1,414,653 A * | 5/1922 | Kratz | F02N 11/08 290/28 |
| 8,510,019 B2 * | 8/2013 | Okumoto | F02N 11/0844 123/179.4 |
| 2011/0196570 A1 * | 8/2011 | Nakamura | F02N 11/0862 701/31.4 |
| 2011/0203410 A1 * | 8/2011 | Notani | F02N 15/02 74/7 R |

FOREIGN PATENT DOCUMENTS

| | | |
|---|---|---|
| JP | 2000-045920 A | 2/2000 |
| JP | 2006-342719 A | 12/2006 |
| JP | 4214401 B2 | 1/2009 |

OTHER PUBLICATIONS

PCT International Search Report on application PCT/JP2012/069945 mailed Oct. 30, 2012; 1 page.

* cited by examiner

*Primary Examiner* — Mahmoud Gimie
(74) *Attorney, Agent, or Firm* — Foley & Lardner LLP

(57) ABSTRACT

An engine control apparatus includes an engine control unit that is configured to control a ring gear, a starting device and a pinion gear. The engine control unit is further configured to perform a control to engage the ring gear and pinion gear with each other in an idling stop state, and to control a pinion gear driver. The pinion gear driver actuates the pinion gear to disengage from the ring gear. In particular, the pinion gear driver actuates the pinion gear to disengage from the ring gear while the ring gear is not rotated and while a starter motor of the starting device is rotated or while injectors of an engine are caused to inject fuel into cylinders of the engine to ignite an air-fuel mixture therein, so as to release engagement of the pinion and ring gears.

4 Claims, 5 Drawing Sheets

ENGINE CONTROL APPARATUS

TECHNICAL FIELD

The present invention relates to an engine control apparatus for a vehicle equipped with an idling stop function, the apparatus preventing an engine startup failure and the occurrence of a failure of an engine starting device.

BACKGROUND ART

Patent Document 1 describes an engine automatic stop and restart device for use with an idling stop-capable vehicle that restarts using a starter, the device having a starter pinion gear engaged with an engine ring gear beforehand to shorten the time required to restart the engine from an idling stop state.

Patent Document 2 describes an engine starting device which, as a measure to reduce noise upon engine startup, causes the pinion gear and the ring gear to be engaged gently with each other while the engine is being stopped before getting started.

Vehicles equipped with the techniques of Patent Document 1 or 2 have the pinion gear and the ring gear kept engaged with each other when stopped. When restarted after being inactive for an extended period of time especially in cold regions, such vehicles may fail to get the pinion gear and the ring gear disengaged from each other due to freezing, which can result in a failure.

As a measure to avoid such an eventuality, Patent Document 3 describes a technique which, when the ignition system of the vehicle is turned off, disengages the pinion gear from the ring gear using a pinion drive means for causing the pinion gear to slide over the ring gear along an output rotation shaft, thereby preventing a failure stemming from the pinion gear being stuck with the ring gear at the next restart.

PRIOR ART DOCUMENTS

Patent Documents

Patent Document 1: Japanese Patent 4214401
Patent Document 2: JP-2000-45920-A
Patent Document 3: JP-2006-342719-A

SUMMARY OF THE INVENTION

Problem to be Solved by the Invention

However, the problem is that if the engine stops with the pinion gear and the ring gear engaged with each other generating frictional force therebetween, it can be difficult using the technique of Patent Document 3 to actuate the pinion drive means to disengage these gears unfailingly against the frictional force while the ignition system of the vehicle is being turned off.

Means for Solving the Problem

In solving the aforementioned problem and according to the present invention, there is provided an engine control apparatus comprising a ring gear for transmitting torque to an engine, a starting device for starting the engine, a pinion gear supported on an output rotation shaft of a starter motor of the starting device, and a pinion gear drive means for sliding the pinion gear on the output rotation shaft, the engine control apparatus being equipped with an idling stop function to stop the engine during engine idling, the engine control apparatus further performing control to engage the ring gear and the pinion gear with each other in an idling stop state. When the ring gear and the pinion gear are to be disengaged from each other, the pinion gear drive means actuates the pinion gear to disengage from the ring gear while the starter motor of the starting device is rotated simultaneously, thereby releasing the engagement.

When the ring gear and the pinion gear are to be disengaged from each other, the engine control apparatus of the present invention causes the pinion gear drive means to actuate the pinion gear to disengage from the ring gear while rotating the starter motor of the starting device simultaneously, thus releasing the engagement.

This patent application incorporates the content of the description and/or the drawings of Japanese Patent Application No. 2011-181605 to which this patent application claims priority.

Effect of the Invention

According to the present invention, the pinion gear and the ring gear are disengaged unfailingly from each other at operation stop, which prevents these gears from being engaged with each other for an extended period of time. This in turn prevents such eventualities as the pinion gear and the ring gear being stuck with each other due to freezing or rust thereby hampering the engine from getting started; a stuck pinion gear overloading the starter motor resulting in a failure; and a helical spline portion of the pinion gear being exposed for an extended time period to gather rust and dust causing the pinion gear to return defectively.

MODES FOR CARRYING OUT THE INVENTION

Figure 1:
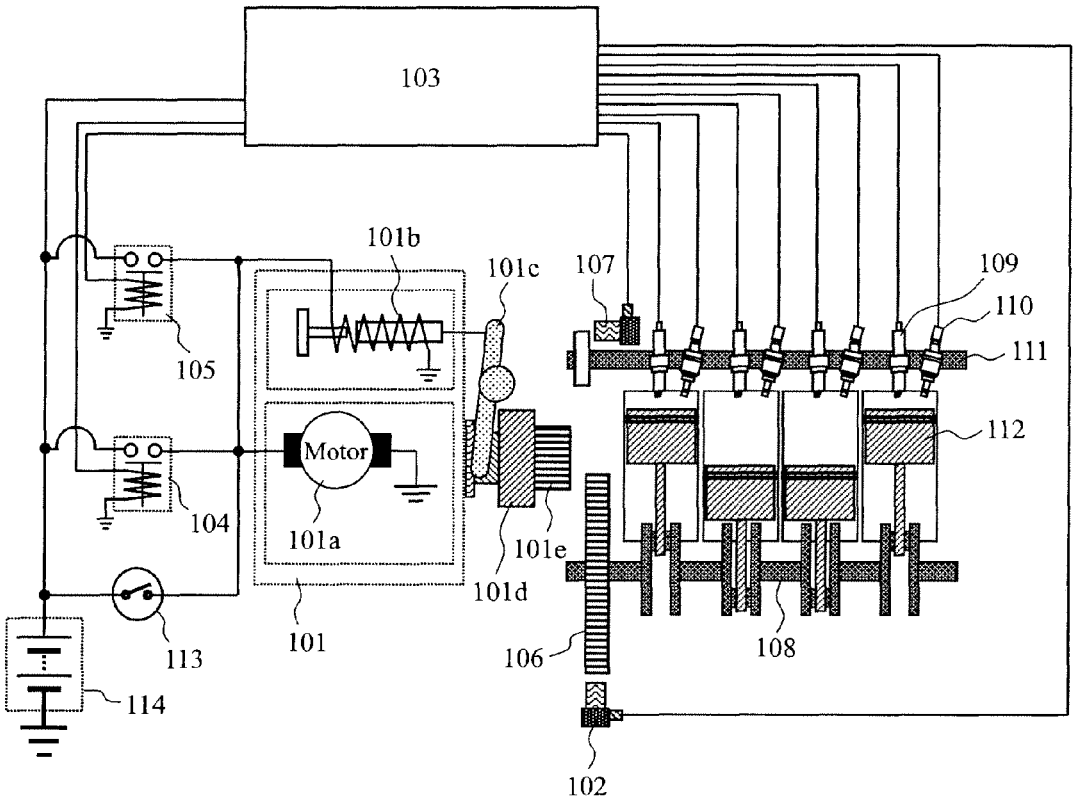
FIG. 1 depicts a functional structure of a system to which the engine control apparatus of the present invention is applied.

FIG. 1 schematically depicts a functional structure of a system to which the engine control apparatus of the present invention is applied. The engine may be a four-cylinder engine for example. Each cylinder of the engine is furnished with an injector 110 and a spark ignition device 109. The injectors 110 and spark ignition device 109 of the cylinders are controlled by an ECU (engine control unit) 103.

The engine has the spark ignition device 109 igniting a mixture of air with fuel injected by the injectors 110 to cause combustion. The combustion pushes down pistons 112 to rotate a crank shaft 108 connected thereto and thereby generates power.

The engine is equipped with a crank angle sensor 102 and a cam angle sensor 107, the crank angle sensor 102 detecting rotational position information on the crank shaft 108, the cam angle sensor 107 detecting rotational position information on a cam shaft 111. The output of these sensors is input to the ECU 103. The ECU 103 discriminates cylinders and optimizes the injection or spark ignition timings based on signals from the crank angle sensor 102 or cam angle sensor 107.

A starter 101 is further used to start the engine. The starter 101 is made up of a starter motor 101*a*, a magnetic switch 101*b*, a shift lever 101*c*, a pinion clutch 101*d*, and a pinion gear 101*e*. When the driver turns on the starter switch 113, the magnetic switch 101*b* is energized. Energizing the magnetic switch 101*b* actuates the shift lever 101*c* to push the pinion gear 101*e* onto the side of the ring gear.

Also, turning on the starter switch 113 energizes and rotates the starter motor 101*a* that in turn rotates the pinion gear 101*e* connected to the same shaft as that of the motor. When pushed onto the side of the ring gear 106 while rotating, the pinion gear 101*e* engages with the ring gear 106. This mechanism allows the crank shaft 108 to rotate and move the pistons 112 up and down, thereby starting the engine.

On the other hand, when the engine is restarted from an idling stop state, the ECU 103 performs control to energize a pinion relay 105 and a starter motor relay 104. This structure allows the engine to be started in the same manner as when the driver turns on the starter switch 113.

While the engine is still running immediately before idling stop, the ECU 103 may also energize the pinion relay 105 causing the magnetic switch 101*b* to be energized and the shift lever 101*c* to be operated. This structure allows the pinion gear 101*e* and ring gear 106 to be engaged with each other and thereby contributes to shortening the time required to restart the engine next time.

EXEMPLARY EMBODIMENTS

First Embodiment

Figure 2:
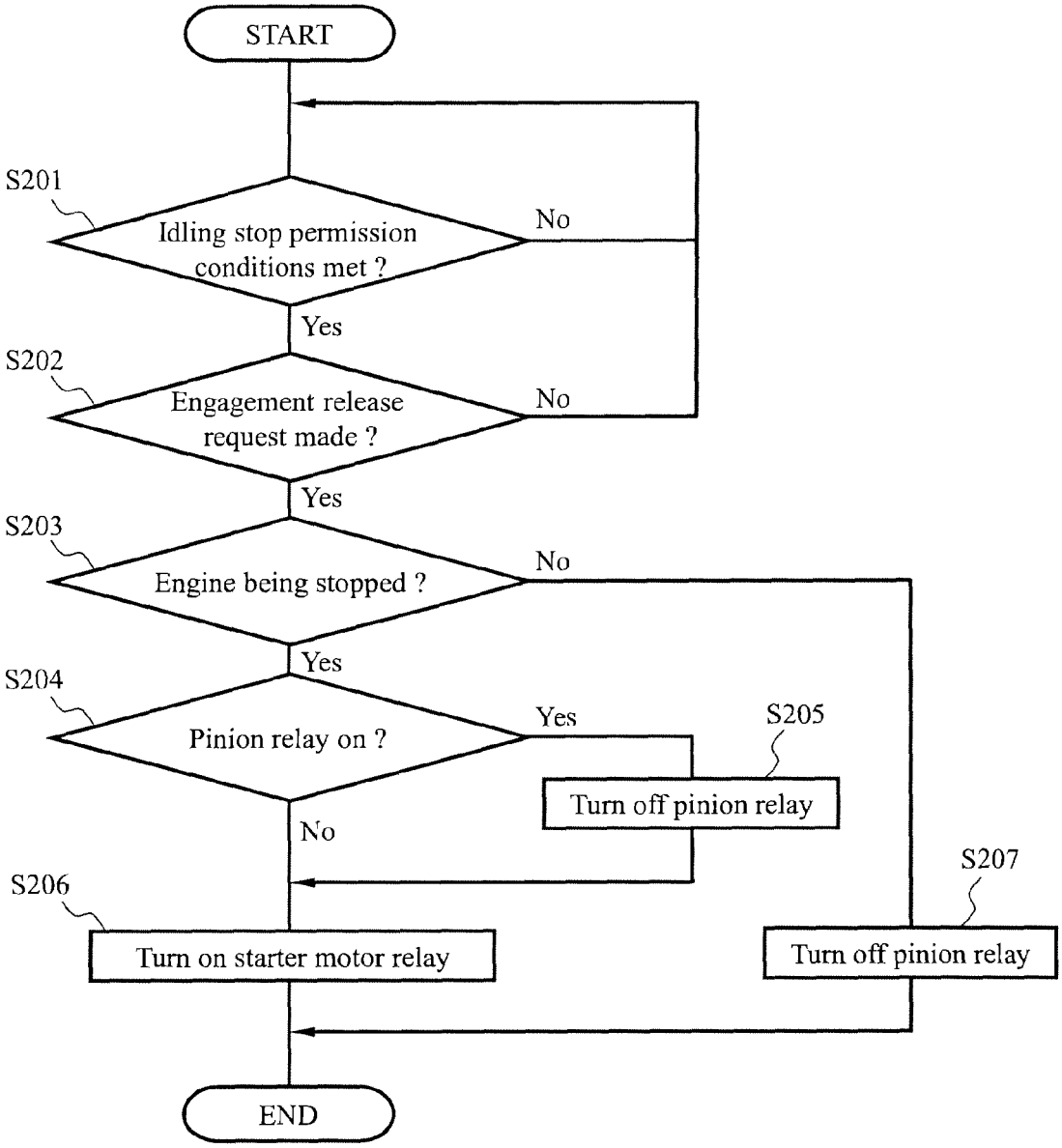
FIG. 2 depicts a flowchart of steps in which an engine control apparatus as a first embodiment of the present invention operates.

FIG. 2 depicts a flowchart of steps in which the engine control apparatus as the first embodiment of the present invention operates.

In step S201, it is determined whether idling stop permission conditions are met. If such conditions are determined to be met, step S202 is reached.

In step S202, it is determined whether a request to release the engagement is made. The engagement release request is made when an end of the operation is detected as a result of the combination of the cab seat door being closed or not, cab seat load sensor status, ignition switch status and the like. If the engagement release request is determined to be made, step S203 is reached.

In step S203, it is determined whether the engine is being stopped. If the engine is determined to be in the stopped state, step S204 is reached. If the engine is not stopped (i.e., if the engine is rotating), then step S207 is reached.

In step S204, it is determined whether the pinion relay is on. If engagement holding control is in effect, the pinion relay is turned on. In this case, step S205 is reached and the pinion relay is turned off in response to a command from the ECU. If engagement holding control is not in effect, the pinion relay is turned off. In this case, step S204 is followed by step S206.

With the pinion relay turned off, the pinion gear loses the support of the shift lever and moves to disengage from the ring gear by means of spring force. However, the metal-to-metal frictional force between the pinion gear and the ring gear keeps the pinion gear engaged with the ring gear.

In step S206, a command from the ECU turns on the starter motor relay. This causes the pinion gear 101*e* to rotate. At this point, with the support of the shift lever lost in step S204, the pinion gear 101*e* rotates to reduce the metal-to-metal frictional force between the pinion gear and the ring gear and thereby releases the engagement therebetween.

In step S207, a command from the ECU turns off the pinion relay 105. With the pinion relay 105 turned off, the pinion gear 101*e* loses the support of the shift lever and moves to disengage from the ring gear by a spring force, thereby releasing the engagement.

Figure 3:
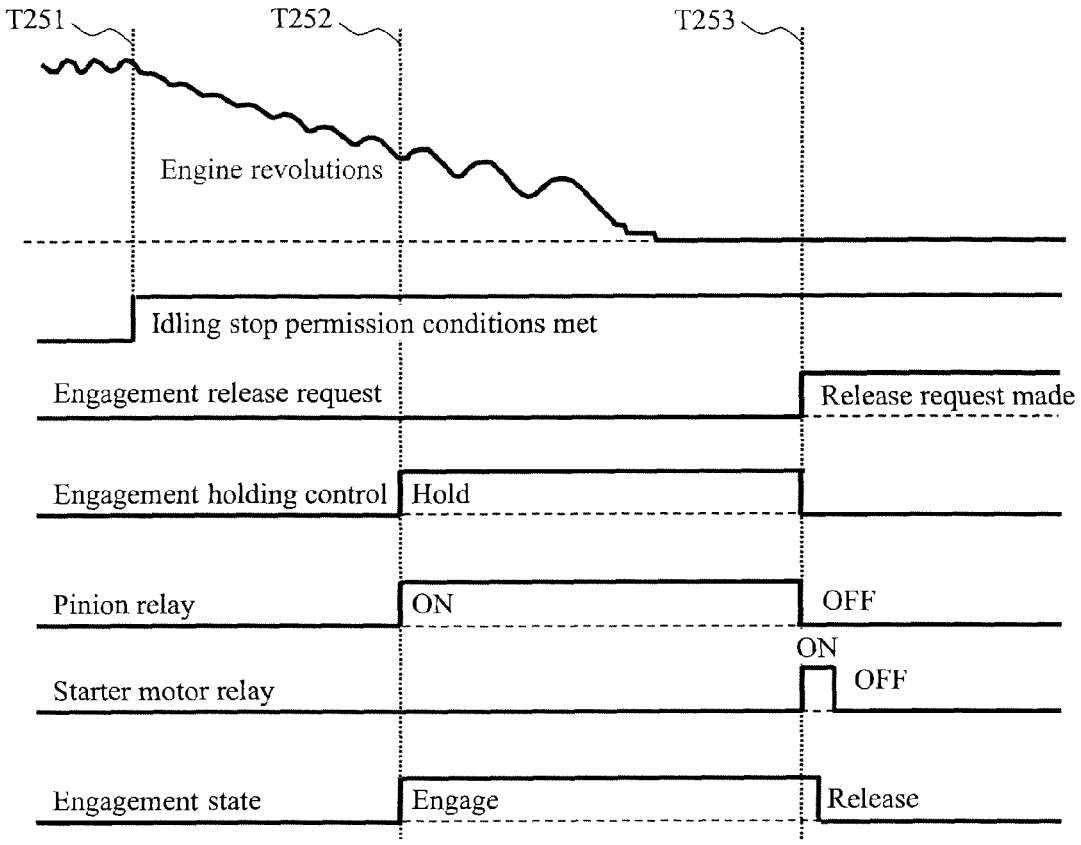
FIG. 3 depicts a timing chart of typical timings at which the engine control apparatus as the first embodiment operates.

FIG. 3 depicts a timing chart of typical timings at which the engine control apparatus as the first embodiment operates (as shown in the flowchart of FIG. 2).

At time T251, the idling stop permission conditions are met, so that fuel to the engine is cut and the engine revolutions begin to drop.

At time T252, the pinion relay is turned on when the engine rotating speed drops below a predetermined rotating speed. This triggers control to engage the pinion gear 101*e* with the ring gear 106 so as to shorten the time to restart.

At time T253, the engagement release request is made to turn off the pinion relay. With the pinion relay turned off, the pinion gear 101*e* loses the support of the shift lever 101*c*, before the starter motor relay 104 is turned on for a short time to rotate the pinion gear 101*e*. This releases the engagement between the pinion gear 101*e* and the ring gear 106. In this manner, the pinion gear 101*e* and the ring gear 106 are disengaged unfailingly from each other by rotating the starter motor at the time of disengagement.

When the starter motor 101*a* of the starting device is to be rotated to release the above-mentioned engagement, the starter motor may be rotated with an amount of power less than that for rotating the starter motor 101*a* normally at engine start time. This saves energy and helps minimize a drop in battery voltage.

Second Embodiment

Figure 4:
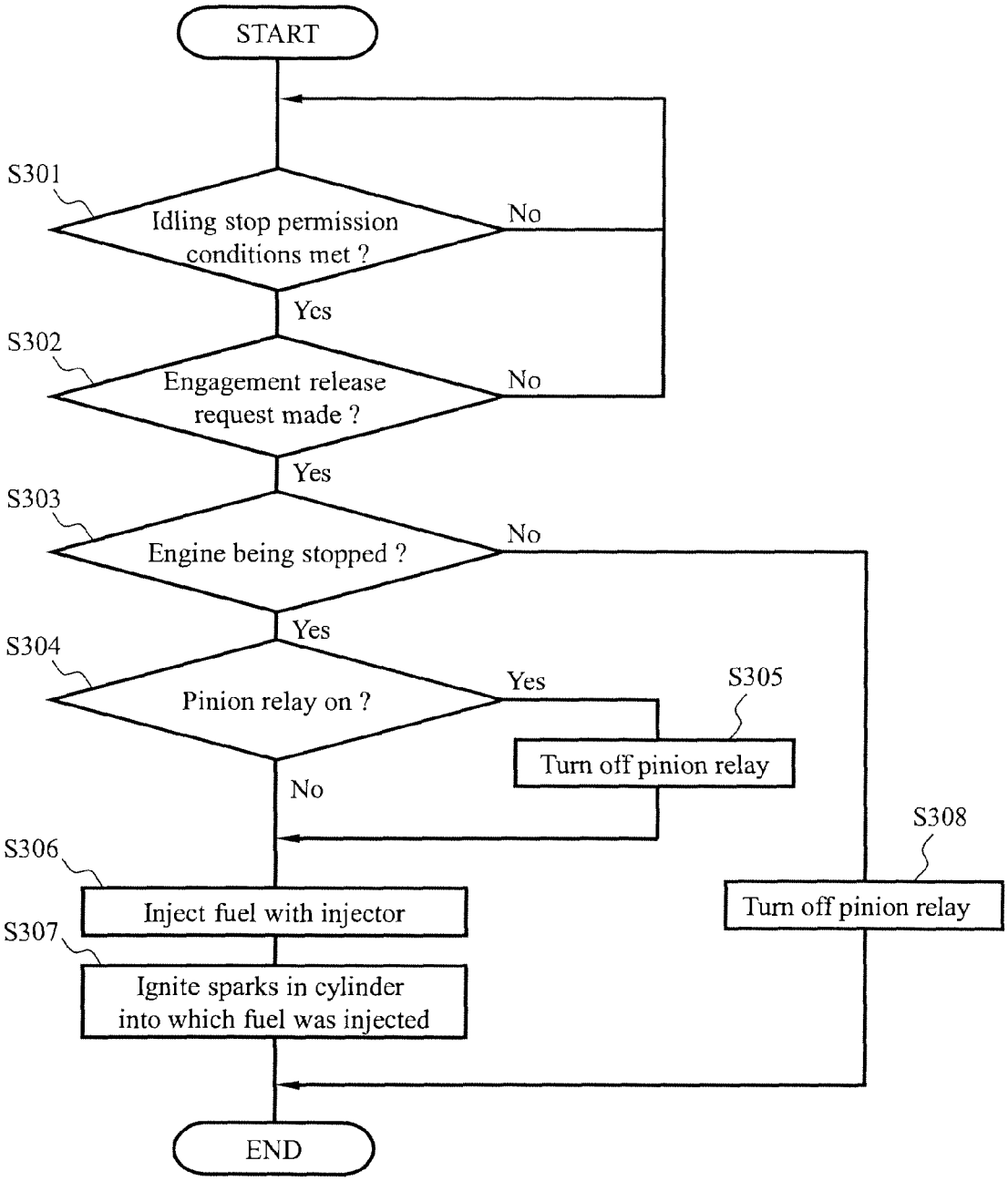
FIG. 4 depicts a flowchart of steps in which an engine control apparatus as a second embodiment of the present invention operates.

FIG. 4 depicts a flowchart of steps in which the engine control apparatus as the second embodiment of the present invention operates.

In step S301, it is determined whether the idling stop permission conditions are met. If the conditions are determined to be met, step S302 is reached.

In step S302, it is determined whether a request to release the engagement is made. The engagement release request is made when an end of the operation is detected as a result of the combination of the cab seat door getting closed or not, cab seat load sensor status, ignition switch status and the like. If the engagement release request is determined to be made, step S303 is reached.

In step S303, it is determined whether the engine is being stopped. If the engine is determined to be in the stopped state, step S304 is reached. If the engine is not stopped (i.e., if the engine is rotating), then step S308 is reached.

In step S304, it is determined whether the pinion relay is on. If engagement holding control is not in effect, the pinion relay is turned off. In this case, step S306 is reached. On the other hand, if engagement holding control is in effect, the pinion relay is turned on. In this case, step S305 is reached and the pinion relay is turned off in response to a command from the ECU. With the pinion relay turned off, the pinion gear 101*e* loses the support of the shift lever 101*c* and moves to disengage from the ring gear 106 by means of spring force. However, the metal-to-metal frictional force between the pinion gear 101*e* and the ring gear 106 keeps these gears engaged.

In step S306, a command from the ECU causes the injector 110 to inject fuel.

In step S307, the spark ignition device 109 of the cylinder into which fuel was injected in step S306 ignites sparks therein. The sparks cause combustion of the air-fuel mixture in the cylinder of interest, generating torque that rotates the ring gear 106. At this point, with the support of the shift lever lost, rotating the ring gear 106 lowers the metal-to-metal frictional force between the pinion gear 101*e* and the ring gear 106 and thereby releases the engagement therebetween.

In step S308, a command from the ECU turns off the pinion relay. With the pinion relay turned off, the pinion gear loses the support of the shift lever and is disengaged from the ring gear by means of spring force. This releases the engagement.

Figure 5:
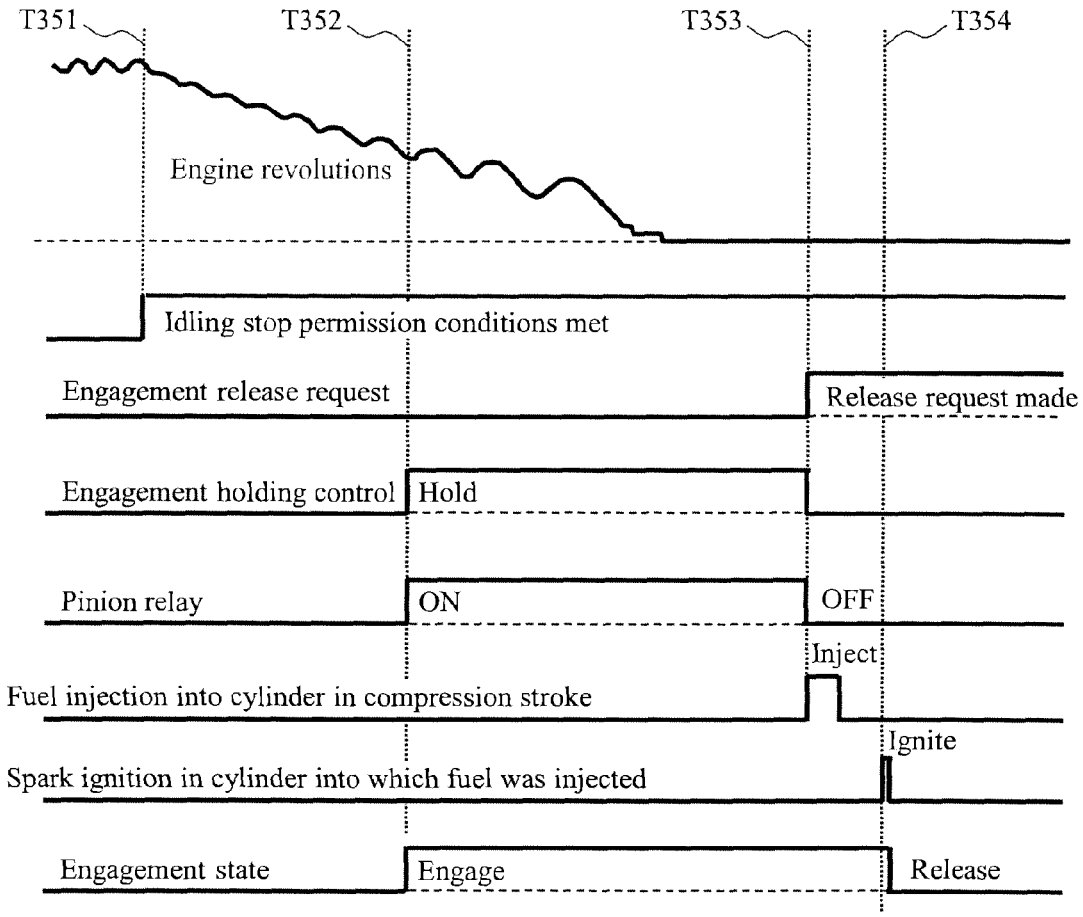
FIG. 5 depicts a timing chart of typical timings at which the engine control apparatus as the second embodiment operates.

FIG. 5 depicts a timing chart of typical timings at which the engine control apparatus as the second embodiment operates (as shown in the flowchart of FIG. 4).

At time T351, the idling stop permission conditions are met, so that fuel to the engine is cut and the engine revolutions begin to drop.

At time T352, the pinion relay 105 is turned on when the engine rotating speed drops below a predetermined rotating speed. This triggers control to engage the pinion gear 101*e* with the ring gear 106 so as to shorten the time to restart.

At time T353, the engagement release request is made to turn off the pinion relay. With the pinion relay turned off, the pinion gear 101*e* loses the support of the shift lever 101*c*. At the same time, the injector 110 injects fuel into the cylinder in the compression stroke.

At time T354, the fuel injected at time T353 spreads throughout the cylinder. At this timing, the spark ignition device 109 ignites the air-fuel mixture in the fuel-injected cylinder. As a result, the ring gear 106 rotates to disengage from the pinion gear 101*e*. In this manner, the pinion gear 101*e* and the ring gear 106 are disengaged unfailingly from each other by igniting the air-fuel mixture in the fuel-injected cylinder at the time of disengagement.

In each of the above-described embodiments, the engine control apparatus may be furnished with a function to maintain at a predetermined level or higher the brake pressure of the braking device of the vehicle incorporating the apparatus, when the pinion gear 101*e* and the ring gear 106 are disengaged from each other. This function will contribute to improving safety by preventing unpredictable movement of the vehicle, among others. All publications, patents, and patent applications cited in this description are hereby incorporated by reference.

EXPLANATION OF LETTERS OR NUMERALS

101 Starter
101*a* Starter motor
101*b* Magnetic switch
101*c* Shift lever
101*d* Pinion clutch
101*e* Pinion gear
102 Crank angle sensor
103 ECU (engine control unit)
104 Starter motor relay
105 Pinion relay
106 Ring gear
107 Cam angle sensor
108 Crank shaft
109 Spark ignition device
110 Injector
111 Cam shaft
112 Piston
113 Starter switch
114 Battery
T251 Timing at which idling stop permission conditions are met
T252 Timing at which engagement holding control is started
T253 Timing at which engagement release request is made
T351 Timing at which idling stop permission conditions are met
T352 Timing at which engagement holding control is started
T353 Timing at which engagement release request is made
T354 Spark ignition timing

The invention claimed is:

1. An engine control apparatus comprising:

an engine control unit configured to control a ring gear for transmitting torque to an engine, a starting device for starting said engine, a pinion gear supported on an output rotation shaft of a starter motor of said starting device, and a pinion gear driver configured to slide said output rotation shaft;

wherein the engine control unit is configured to perform an idling stop function to stop said engine during engine idling, said engine control unit being configured to further perform control to engage said ring gear and said pinion gear with each other in an idling stop state;

wherein, when said ring gear and said pinion gear are to be disengaged from each other, said pinion gear driver actuates said pinion gear to disengage from said ring gear while the starter motor of said starting device is rotated simultaneously and while said ring gear is not rotated, thereby releasing engagement of the ring gear and the pinion gear.

2. An engine control apparatus according to claim 1, wherein, when the starter motor of said starting device is to be rotated to release said engagement, said starter motor is rotated with an amount of power less than that for rotating said starter motor normally at engine start time.

3. An engine control apparatus comprising:

an engine control unit configured to control a ring gear for transmitting torque to an engine, a starting device for starting said engine, a pinion gear supported on an output rotation shaft of a starter motor of said starting device, and a pinion gear driver configured to slide said pinion gear on said output rotation shaft, wherein the engine control unit is configured to perform an idling stop function to stop said engine during engine idling, said engine control unit being configured to further perform control to engage said ring gear and said pinion gear with each other in an idling stop state;

wherein, when said ring gear and said pinion gear are to be disengaged from each other, said pinion gear driver actuates said pinion gear to disengage from said ring gear while injectors of said engine are caused simultaneously to inject fuel into cylinders of said engine to ignite an air-fuel mixture therein and while said ring gear is not rotated, thereby releasing engagement of the ring gear and the pinion gear.

4. An engine control apparatus according to claim 1, wherein, when said ring gear and said pinion gear are to be disengaged from each other, the engine control unit is configured to issue a command to maintain at a predetermined level or higher a brake pressure of a vehicle incorporating said engine control apparatus.

* * * * *